US010459377B2

(12) United States Patent
Hirose

(10) Patent No.: US 10,459,377 B2
(45) Date of Patent: Oct. 29, 2019

(54) PEELING MEMBER AND MANUFACTURING METHOD FOR THE SAME

(71) Applicant: NTN CORPORATION, Osaka (JP)

(72) Inventor: Kazuo Hirose, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 15/760,598

(22) PCT Filed: Sep. 15, 2016

(86) PCT No.: PCT/JP2016/077344
§ 371 (c)(1),
(2) Date: Mar. 15, 2018

(87) PCT Pub. No.: WO2017/047723
PCT Pub. Date: Mar. 23, 2017

(65) Prior Publication Data

US 2019/0041777 A1 Feb. 7, 2019

(30) Foreign Application Priority Data

Sep. 15, 2015 (JP) ..... 2015-182312
Sep. 15, 2016 (JP) ..... 2016-180053

(51) Int. Cl.
*G03G 15/20* (2006.01)
*G03G 15/00* (2006.01)
*B05D 5/08* (2006.01)

(52) U.S. Cl.
CPC ..... *G03G 15/2028* (2013.01); *G03G 15/6532* (2013.01); *B05D 5/083* (2013.01)

(58) Field of Classification Search
CPC ..... G03G 15/2028; G03G 15/6532
See application file for complete search history.

(56) References Cited

U.S. PATENT DOCUMENTS 6,029,038 A * 2/2000 Uehara ..... G03G 15/2028 399/323
2002/0041777 A1* 4/2002 Sirejacob ..... G03G 15/0812 399/274

(Continued)

FOREIGN PATENT DOCUMENTS

EP 2592492 A1 5/2013
JP 09-101707 A 4/1997

(Continued)

OTHER PUBLICATIONS

International Search Report for PCT/JP2016/077344 dated Oct. 25, 2016.

(Continued)

*Primary Examiner* — Ryan D Walsh
(74) *Attorney, Agent, or Firm* — Hedman & Costigan, P.C.; James V. Costigan; Kathleen A. Costigan

(57) ABSTRACT

Peeling member formed by a metal plate having a resin coating film thereon, the peeling member being capable of preventing adhesion of a paper right after fixing for a long period of time, and to provide a manufacturing method for the peeling member capable of forming a fine recessed portion on a surface of the resin coating film for preventing the adhesion of the paper. Peeling member 1 includes a peeling sheet 1*a* having a base material 2 having a plate shape, and a resin coating film 4 formed on at least a surface of the base material 2 at a paper passing side. The peeling member is formed to peel a paper from a fixing member of an electronic photographic device by arranging a distal end portion 1*c* to be contacted with or close to the fixing member.

7 Claims, 5 Drawing Sheets

(56) References Cited

U.S. PATENT DOCUMENTS

| | | | | |
|---|---|---|---|---|
| 2004/0120735 | A1* | 6/2004 | Baba | G03G 15/2028 399/323 |
| 2010/0285303 | A1* | 11/2010 | Wu | C09D 127/12 428/323 |
| 2012/0213546 | A1* | 8/2012 | Kawamata | G03G 15/161 399/101 |
| 2013/0121735 | A1 | 5/2013 | Mikutsu | |
| 2013/0330110 | A1 | 12/2013 | Yoshikawa | |
| 2016/0124361 | A1 | 5/2016 | Watanabe | |
| 2017/0357195 | A1* | 12/2017 | Hirose | B23K 26/22 |
| 2018/0210378 | A1* | 7/2018 | Kunugi | G03G 15/2028 |

FOREIGN PATENT DOCUMENTS

| | | | |
|---|---|---|---|
| JP | 2001-235959 | A | 8/2001 |
| JP | 2007-047379 | A | 2/2007 |
| JP | 2007-193063 | A | 8/2007 |
| JP | 2011-008103 | A | 1/2011 |
| JP | 2011-043763 | A | 3/2011 |
| JP | 2013-105009 | A | 5/2013 |
| JP | 2013-254077 | A | 12/2013 |
| JP | 2016-000990 | A | 5/2016 |

OTHER PUBLICATIONS

English Abstract for JP 2001-235959 A dated Aug. 31, 2001.
English Abstract for JP 2011-008103 A dated Jan. 13, 2011.
English Abstract for JP 2011-043763 A dated Mar. 3, 2011.
English Abstract for JP 2013-254077 A dated Dec. 19, 2013.
English Abstract for JP 2013-105009 A dated May 30, 2013.
English Abstract for JP 2007-193063 A dated Aug. 2, 2007.
English Abstract for JP 2007-047379 A dated Feb. 22, 2007.
English Abstract for JP 09-101707 A dated Apr. 15, 1997.
English Abstract for JP 2016-090996 A dated May 23, 2016.

* cited by examiner

PEELING MEMBER AND MANUFACTURING METHOD FOR THE SAME

TECHNICAL FIELD

The present invention relates to a peeling member that peels a paper from a fixing member such as a fixing roller and a fixing belt arranged in an electronic photographic device such as a copying machine and a laser printer.

BACKGROUND ART

In an electronic photographic device such as a copying machine and a laser printer, a thermal fixing device that develops an electrostatic latent image formed on a photoreceptor drum on a paper by using a developing agent such as toner and then fixes the developed image is arranged. The thermal fixing device is provided with a fixing member such as a fixing roller and a fixing belt for fixing the developing agent on a paper by heating and melting and pressing the developing agent.

In the fixing member or a pressing roller that presses the fixing member against a paper, a sheet-like peeling member that peels a paper on which the developing agent is fixed from the roller or the like is used in order to prevent the paper from winding around the roller and interrupting smooth operation of the roller. As such a peeling member, a peeling member having a distal end portion of the peeling member covered with fluororesin in order to improve paper peeling performance and prevent a paper from being contaminated due to adhesion of the toner has been increasing.

For example, a peeling member having a distal end portion of a base material covered with a fluororesin film is disclosed in Patent Document 1. In Patent Document 1, the fluororesin film is adhered to a surface of the base material via a silicon-based adhesive (see Patent Document 1). Further, a peeling member having a distal end portion of a base material is covered with fluororesin coating film formed by a coating process is disclosed in Patent Document 2. In Patent Document 2, a spherical filler such as a resin balloon, a ceramic balloon, and a glass balloon is added to the fluororesin coating film (see Patent Document 2).

Further, in Patent Document 3, a configuration in which a plurality of recessed portions is formed on a surface of a resin coating film by forming a dimple like recessed portion on a paper passing surface of a metal plate as a base material, and a configuration in which a recessed portion is formed on a paper passing surface of a fluororesin film by forming a plurality of through holes on a paper passing surface of a sheet metal and adhering the fluororesin film on the sheet metal are disclosed (see Patent Document 3). In Patent Documents 2 and 3, a paper can be separated from the roller smoothly by reducing a contact area with the paper.

PRIOR ART DOCUMENTS

Patent Documents

Patent Document 1: JP 2001-235959 A
Patent Document 2: JP 2011-008103 A
Patent Document 3: JP 2011-043763 A

SUMMARY OF THE INVENTION

Problems to be Solved by the Invention

However, in the developing agent adopted in an electronic photographic device of recent years, in order to improve color developing performance, binder resin as one component of toner is changed to polyester binder resin with high transparency. Since the toner containing polyester binder resin has extremely high adhesiveness, a paper is adhered to a peeling sheet to which a fluororesin film is adhered or a paper passing surface having a flat shape of a peeling member coated with a resin coating film, and thereby jamming might occur.

In the peeling member disclosed in Patent Document 2, the spherical filler might be flocculated or deviation of a distribution of the spherical filler might be generated. In such a case, uniform recess and projection is not obtained, and therefore discharge of a paper is not performed smoothly because non-adhesiveness is locally different in the peeling member. Consequently, jamming might occur. Further, in the peeling member disclosed in Patent Document 3, the recessed portion is formed on the base material so that the recessed portion is formed on a surface of the resin coating film or the resin film. Thus, a minimum diameter of the recessed portion becomes large up to approximately φ 5 mm. Further, since strength of the base material is deteriorated by setting an interval of the recessed portions to be small, the interval of several millimeters is needed, however a paper might be adhered to a flat portion of the interval of the several millimeters. Especially, jamming of a thin paper on which a contact print is performed might occur.

High resolution, high printing speed, compactification, complexness of a flow of a paper caused by installation of a both-side copying function, or the like in the electronic photographic device is promoted in recent years, and when a paper is slightly adhered (attracted) to the peeling member, jamming or folding of a paper is generated and therefore a desired operation quality might not be maintained.

An object of the present invention is, in order to solve such a problem, to provide a peeling member formed by a metal plate or the like and a resin coating film formed on the metal plate, the peeling member being capable of preventing adhesion of a paper right after fixing for a long period of time, and to provide a manufacturing method for the peeling member capable of forming a fine recessed portion on a surface of the resin coating film for preventing the adhesion of the paper.

Means for Solving the Problem

A peeling member of the present invention includes a peeling sheet formed by a base material having a plate shape, and a resin coating film formed on at least a surface of the base material at a paper passing side. The peeling member is formed to peel a paper from a fixing member of an electronic photographic device by arranging a distal end portion, which is an end portion at a side of one long side of the peeling sheet and at an upstream side in a paper passing direction, to be contacted with or close to the fixing member. The resin coating film includes a plurality of recessed portions on a surface of the resin coating film at the paper passing side, and a recess is not formed on the base material as a base part of the recessed portion.

Here, "to be contacted" means that one side (the distal end portion) of the peeling sheet is linearly contacted with the fixing member in an axial direction. Further, "to be close" means that the one side (the distal end portion) of the peeling sheet is arranged close to a roller to such an extent that a paper can be prevented from winding around the roller or the like. Further, the fixing member denotes a member formed in either of a roller-like shape, a film-like shape, or a belt-like shape capable of contacting with a paper in a step of heating and at the same time pressing an undeveloped developing agent on a paper so as to be fixed on the paper. Examples of the fixing member include a fixing roller, a pressing roller and the like.

The recessed portion may be formed as linear grooves inclined in one direction or two directions against the paper passing direction and aligned along a longitudinal direction of the peeling sheet at the same intervals.

The resin coating film may include a matrix resin containing at least powder of fluororesin and powder of graphite, and the resin coating film may contain 25 to 70 parts by weight of the fluororesin and 1 to 20 parts by weight of the graphite against 100 parts by weight of the matrix resin. Further, the matrix resin may be formed of a polyamide imide (PAI) resin. Further, the fluororesin may be formed of a polytetrafluoroethylene (PTFE) resin, and the graphite may contain 97.5% or more of fixed carbon.

A manufacturing method for the peeling member of the present invention includes a coating film forming step of forming a resin coating film by drying a resin coating material after applying the resin coating material including a matrix resin on at least a surface of the base material of the peeling member at the paper passing side, a coating film baking step of baking and hardening the resin coating film, and a recessed portion forming step of forming a portion, which becomes a recessed portion when the coating film baking step is performed, on the surface of the resin coating film at the paper passing side after the coating film forming step and before the coating film baking step.

The recessed portion may be formed as linear grooves inclined in one direction or two directions against the paper passing direction and aligned along a longitudinal direction of the peeling sheet at the same intervals, and the linear groove may be formed in the recessed portion forming step by pressing a rotation member including an outer periphery having a helical gear shape against the surface of the resin coating film while rotating.

Effects of the Invention

The peeling member of the present invention includes the peeling sheet formed by the base material having a plate shape, and the resin coating film formed on at least the surface of the base material at the paper passing side, and the resin coating film includes a plurality of the recessed portions on the surface of the resin coating film at the paper passing side, and a recess is not formed on the base material as a base part of the recessed portion. Consequently, the peeling member has excellent paper peeling performance and toner non-adhesiveness, and printing of an image having an image ratio of 90% or more can be performed without adhesion and jamming of a paper to the peeling member. Further, since it is not necessary to perform a process of forming a projection and recess on the base material, high horizontal accuracy (straightness accuracy) of the distal end portion of the peeling sheet can be maintained, and less variation in quality can be achieved.

The recessed portion is formed as linear grooves inclined in one direction or two directions against the paper passing direction and aligned along a longitudinal direction of the peeling sheet at the same intervals. Consequently, excellent low friction performance can be especially obtained, and therefore adhesion of a paper right after the fixing can be further prevented. Further, the peeling member is contacted with a paper in a linear contact manner, and thereby image deterioration such as gloss unevenness and gloss stripes of the image can be prevented.

The resin coating film includes the matrix resin containing at least powder of fluororesin and powder of graphite, and the resin coating film contains 25 to 70 parts by weight of the fluororesin and 1 to 20 parts by weight of the graphite against 100 parts by weight of the matrix resin. Consequently, excellent low friction performance and wear resistance of the resin coating film can be obtained. Further, since the matrix resin is formed of the PAI resin, excellent heat resistance, wear resistance, and adhesiveness with the base material can be obtained.

The manufacturing method for the peeling member of the present invention includes the coating film forming step of forming a resin coating film by drying a resin coating material after applying the resin coating material including a matrix resin on at least a surface of the base material of the peeling member at the paper passing side, the coating film baking step of baking and hardening the resin coating film, and the recessed portion forming step of forming a portion, which becomes the recessed portion when the coating film baking step is performed, on the surface of the resin coating film at the paper passing side, after the coating film forming step and before the coating film baking step. That is, the recessed portion forming step is performed between the coating film forming step and the coating film baking step, and thereby the recessed portion is formed by means of transfer or the like in a state in which the resin coating film is flexible right after coating and drying, and then the resin coating film having the recessed portion can be formed by baking and hardening the flexible resin coating film. With this, fine and precise recessed portion can be formed on the surface of the peeling member, compared to a case in which the recessed portion is formed on the surface of the coating film after forming the coating film (after baking), or a case in which a recess is formed on the surface of the base material before forming the resin coating film.

The recessed portion is formed as linear grooves inclined in one direction or two directions against the paper passing direction and aligned along a longitudinal direction of the peeling sheet at the same intervals, and the linear groove is formed in the recessed portion forming step by pressing the rotation member including the outer periphery having a helical gear shape against the surface of the resin coating film while rotating. Consequently, excellent productivity of the peeling member can be obtained.

MODE FOR CARRYING OUT THE INVENTION

Figure 1:
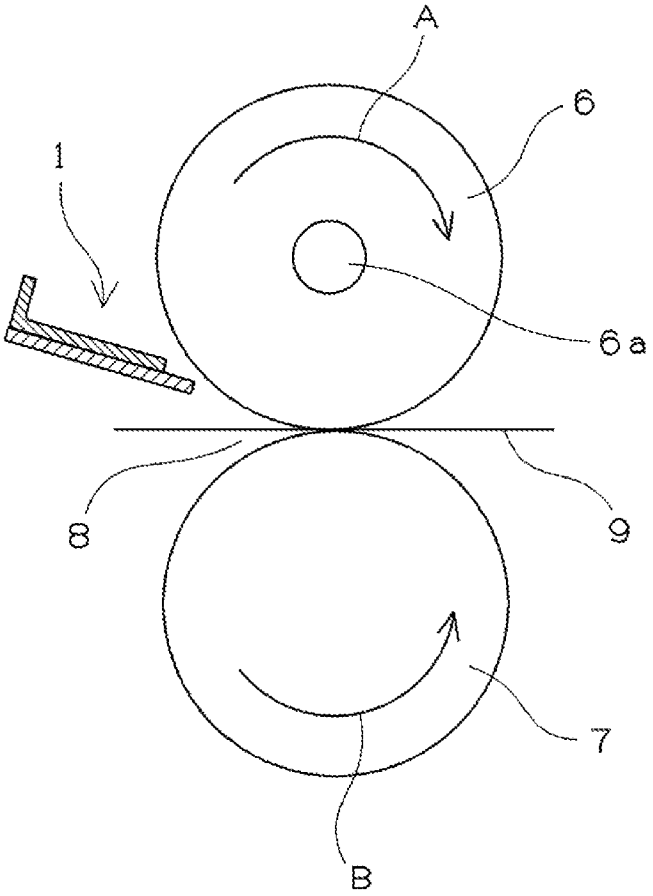
FIG. 1 illustrates a schematic view of a fixing device using a peeling member of the present invention.

A fixing device using a peeling member of the present invention is described with reference to FIG. 1. FIG. 1 is a schematic view of a heat roller type fixing device using a peeling member. The fixing device is provided with a fixing roller 6 in which a heater 6*a* is installed, the fixing roller 6 rotated in a direction of an arrow A, a pressing roller 7 rotated in a direction of an arrow B while contacting with the fixing roller 6, and a peeling member 1 arranged adjacent to a nip portion 8 formed when the fixing roller 6 and the pressing roller 7 are contacted with each other. A toner image formed on a paper 9 is fixed at the nip portion 8 and turned into a fixed image. In order to peel the paper 9 passed through the nip portion 8 from the fixing roller 6, the peeling member 1 is arranged to be contacted with or to be close to the fixing roller 6.

Figure 2:
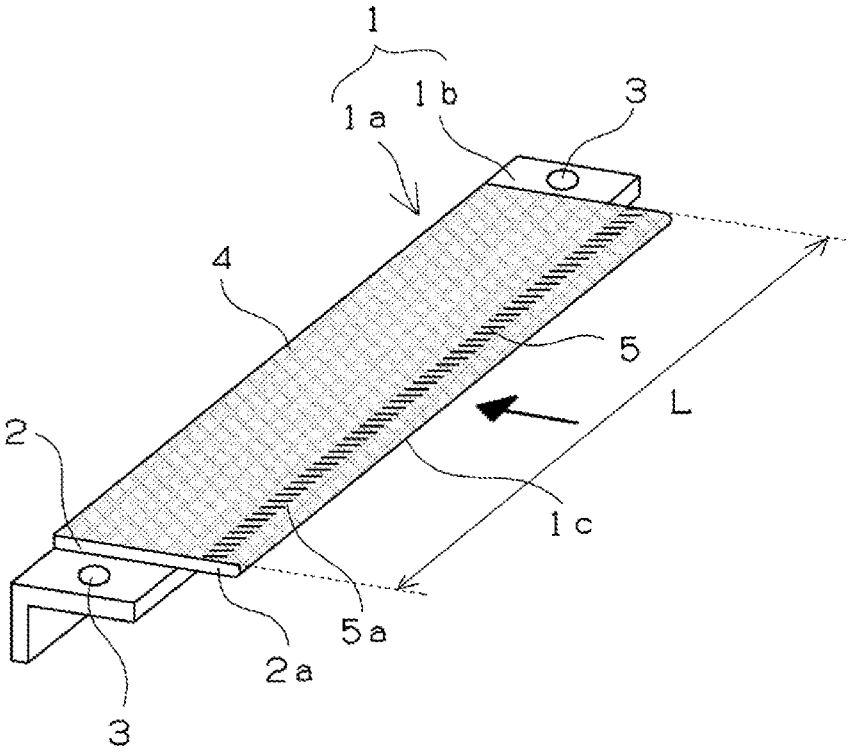
FIG. 2 illustrates a perspective view of one example of the peeling member of the present invention.

One example of the peeling member of the present invention is described with reference to FIG. 2. FIG. 2 is a perspective view of the peeling member. As shown in FIG. 2, the peeling member 1 is provided with a peeling sheet 1*a*, and a support member 1*b* that supports and fixes the peeling sheet 1*a*. The peeling sheet 1*a* is formed by a base material 2 having a substantially rectangular shape in a plane view and a resin coating film 4 formed on a surface of the base material 2. A black arrow in the figure indicates a paper passing direction, and a longitudinal direction of the peeling sheet 1*a* is orthogonal to the paper passing direction. In the peeling sheet 1*a* and the base material 2, a paper passing side surface is opposite to a surface supported and fixed by the support member 1*b*. A distal end portion 1*c*, which is an end portion at an upstream side in the paper passing direction of the peeling sheet 1*a* of the peeling member 1, is arranged to be close to the fixing roller so that the distal end portion 1*c* scoops an end portion of a paper peeled from the fixing roller (see FIG. 1). In the peeling member 1, a pattern portion 5 formed by a plurality of recessed portions 5*a*, which is arranged on a surface of the resin coating film 4 and arranged along a longitudinal direction the resin coating film 4, is formed near the distal end portion contacted with a paper right after the fixing.

The resin coating film 4 may be formed on at least the surface of the base material at a side through which a paper is passed (the paper passing side surface). In the configuration shown in FIG. 2, a distal end of the distal end portion 2*a* of the base material 2 is covered with the resin coating film 4 and thereby the resin coating film 4 is formed on both of a front surface and a rear surface of the base material 2. The resin coating film 4 has the pattern portion 5 described above on the paper passing side surface of the resin coating film 4, and a recess is not formed on the base material 2 as a base part of the recessed portion. This configuration can be obtained by not processing the base material but forming the pattern portion on a surface of the coating film after a coating and drying process of the resin coating material and before a baking process. The resin coating film 4 can prevent a paper right after fixing from adhering for a long period of time.

The pattern portion 5 on the paper passing side surface of the resin coating film 4 is formed by a plurality of the recessed portions 5*a*. The pattern portion 5 is formed in a region slid on a paper. A shape of the recessed portion is not especially limited, and therefore any shape such as a dimple recessed hole and a recessed groove may be adopted. Further, a depth of the recessed portion may be formed such that the recessed portion reaches the surface of the base material. The recessed groove may be formed as, for example, a geometrical pattern groove such as a one direction inclined pattern groove and a twill pattern groove. In the configuration shown in FIG. 2, the pattern portion 5 is formed as the one direction inclined pattern groove. The one direction inclined pattern groove and the twill pattern groove are formed by linear grooves inclined in one direction or two directions (twill pattern) against a paper passing direction and aligned at the same intervals. Each of the pattern grooves is set to, for example, a groove width of 1.0 mm or less, a groove interval of 0.1 mm to 5.0 mm, and an inclined angle of 15° to 45° against the paper passing direction. Further, the dimple recessed hole is set to, for example, a diameter of φ 0.2 mm to φ 2.0 mm, and an interval of 0.5 mm to 2 mm. By forming the pattern groove having the fine recessed portions as described above, adhesion of the paper to the peeling member due to toner heated and pressed on the paper can be suppressed, jamming of the paper can be prevented, and excellent durability of the peeling member can be obtained.

The resin coating film 4 is obtained by coating the base material 2 with a resin coating material. The resin coating material is obtained by dispersing or dissolving a matrix resin and other compounding agent, each of which becomes a solid content, into a solvent. A detail of a forming method of the resin coating film 4 is described below.

As the matrix resin, resin having excellent adhesiveness and excellent heat resistance may be adopted. Specifically, examples of the matrix resin include a PAI resin, a polyphenylene sulfide (PPS) resin, a polyether ether ketone resin, a polyimide (PI) resin, a polyamide resin, an epoxy resin, and a phenol resin. Of these resins, the PAI resin is preferable because excellent heat resistance, wear resistance, and adhesiveness with the base material are obtained.

As the solvents into which the matrix resin or the like is dispersed, for example, ketones such as acetone, methyl ethyl ketone; esters such as methyl acetate and ethyl acetate; aromatic hydrocarbons such as toluene and xylene; organic halogen compounds such as methyl chloroform, trichloroethylene, and trichlorotrifluoroethane; and non-proton extreme solvents such as N-methyl-2-pyrrolidone (NMP), methylisopyrrolidone (MIP), dimethylformamide (DMF), dimethylacetamide (DMAC) may be used. These solvents can be used independently or as mixtures thereof. A kind of the solvent and viscosity thereof may be adjusted in accordance with a coating method of the resin coating material.

In order to further improve friction and wear performance of the resin coating film of the peeling member, it is preferable to compound at least fluororesin powder and carbon powder as a compounding agent into the matrix resin.

As the fluororesin, resin having heat resistance and capable of imparting low friction performance and unadhesiveness to the resin coating film may be adopted. Examples of the fluororesin, include a PTFE resin, a tetrafluoroethylene-perfluoroalkyl vinyl ether (PFA) copolymer resin, a tetrafluoroethylene-hexafluoropropylene (FEP) copolymer resin, and a tetrafluoroethylene-ethylene (ETFE) copolymer resin. Of these fluororesins, it is preferable to adopt powder of the PTFE resin.

In a case in which the powder of the PTFE resin is adopted, the average particle diameter (a value measured by laser analysis method) of the powder is not especially limited, however it is preferable that the average particle diameter is set to 30 μm or less to keep the surface smoothness of the resin coating film.

The powder of the PTFE resin obtained by baking the PTFE resin at a temperature of its melting point or more may be adopted. The powder obtained by irradiating the baked powder with y rays or electron rays may be also adopted. The baked powder of the PTFE resin has excellent uniform dispersion performance in the resin coating material and imparts excellent wear resistance to the formed resin coating film, compared to unbaked PTFE resin (molding powder, fine powder).

It is preferable that the resin coating film contains 25 to 70 parts by weight of the fluororesin such as the PTFE resin against 100 parts by weight of the matrix resin. In a case in which the compounding amount of the fluororesin is less than 25 parts by weight, the low friction performance is deteriorated, and thereby wear due to heat might be accelerated. On the other hand, in a case in which the compounding amount of the fluororesin exceeds 70 parts by weight, excellent low friction performance can be obtained, while strength of the coating film and the wear resistance might be deteriorated.

It is well known that the graphite has excellent characteristics as a solid lubricant. The graphite is classified into natural graphite and artificial graphite, however both of them can be adopted. Examples of a shape of the graphite include a flaky shape, a granular shape, and a spherical shape, and all of them can be adopted. It is preferable to adopt the graphite having 97.5% or more of fixed carbon, and more favorable to adopt artificial graphite having 98.5% or more of the fixed carbon It is preferable that the resin coating film contains 1 to 20 parts by weight of the graphite against 100 parts by weight of the matrix resin. In a case in which the compounding amount of the graphite is less than 1 part by weight, the effect of adding the graphite to the matrix resin cannot be obtained sufficiently. On the other hand, in a case in which the compounding amount of the graphite exceeds 20 parts by weight, adhesiveness of the resin coating film is deteriorated, and therefore the resin coating film might be peeled.

In addition to the matrix resin, the fluororesin, and the graphite, the resin coating film may contain other additives unless necessary characteristics of the peeling member of the present invention are extremely deteriorated. In a case in which the total amount of the additives such as the fluororesin and the graphite against the matrix resin is less than 15 parts by weight, the resin coating film is ununiform in its thickness, and therefore it is difficult to obtain a required dimensional accuracy.

Further, it is preferable that tensile shear adhesive strength of the resin coating film is set to 25 MPa or more. In such a case, adhesion strength between the base material of the peeling member and the resin coating film becomes high, and therefore the peeling member can be used stably. In a case in which the resin coating film contains the PAI resin as the matrix resin, and the powder of the fluororesin and the powder of the graphite in the preferable compounding range described above, the tensile shear adhesive strength becomes 25 MPa or more.

The distal end portion 2*a* of the base material 2 is, for example, a part having a width of 4 mm from the distal end toward a downstream side in the paper passing direction. The distal end portion 2*a* of the base material 2 defines a distal end portion 1*c* of the peeling sheet 1*a*. Further, the peeling sheet is formed to peel a paper by arranging the distal end portion so as to be contact with or close to the fixing member, and therefore the distal end portion 1*c* of the peeling sheet 1*a* is defined as an end portion at the upstream side in the paper passing direction.

The material of the base material 2 is not especially limited as long as the distal end portion of the peeling sheet can be arranged to be contacted with or close to the fixing member, and therefore a metal material or a resin material may be adopted. As the metal material, for example, steel, aluminum, copper, stainless steel or the like may be adopted. Especially, stainless steel is preferable because stainless steel is not rusted, stainless steel is processed easily and obtained at a low cost. As the resin material, resin having heat resistance that can endure a temperature in baking of the resin coating film may be adopted, and therefore a heat resistant resin such as a liquid crystal polymer reinforced by fiber, a PPS resin and a PI resin may be adopted. In a case in which the resin material is adopted, a resin plate as the base material is formed by means of injection molding or extrusion molding from the resin material.

A plate thickness of the metal plate or the resin plate as the base material 2 is preferably set in a range between 50 μm and 300 μm. In a case in which the plate thickness is less than 50 μm, peeling force might not be secured, or the base material 2 might be deformed in jamming. In a case in which the plate thickness exceeds 300 μm, a paper to be peeled is abutted against the distal end portion of the peeling sheet and thereby jamming might occur. Further, the base material 2 has a contact width L (see FIG. 2) that is substantially the same as a length of the roller in an axial direction. With the contact width being large, contact pressure per unit area against the roller becomes small and therefore local wear of a surface of the roller can be prevented. Further, the length substantially the same as the length of the roller in the axial direction means the length that achieves the effect described above, and specifically the length may be more than substantially half of the length of the roller in the axial direction up to the same as or slightly longer than the length of the roller in the axial direction.

Further, it is preferable that the distal end portion 2*a* of the base material 2 at the upstream side in the paper passing direction is formed in a curved surface without an edge in a thickness direction. Since the end portion is formed in a curved surface in the thickness direction, even if the end portion is contacted with the fixing member such as the fixing roller and the fixing belt in a pressing contact state with more than certain pressure, the surface of the fixing member is not damaged. Further, the resin coating film is formed on the distal end portion 2*a* easily.

As shown in FIG. 2, the support member 1*b* is formed as a thick plate, and holes 3 used for fixing the peeling member to a fixing device body or the like are formed at a left side and a right side in a longitudinal direction of the support member 1*b*. The material similar to the base material 2 may be adopted as the material of the support member 1*b*. It is preferable to set a plate thickness of the thick plate that forms the support member 1*b* to 0.8 mm or more in order to secure strength sufficiently for attaching the base material 2.

A fixing method for the base material 2 and the support member 1*b* is not especially limited. In a case in which the base material 2 is formed of a metal plate and the support member 1*b* is formed of a metal thick plate, the base material 2 and the support member 1*b* are connected to each other by means of welding or the like. In a case in which welding is adopted to connect the base material 2 and the support member 1*b*, in order to prevent horizontal accuracy of the distal end portion 2*a* from being deteriorated due to a shape change of the base material 2, it is preferable to connect the base material 2 and the support member 1*b* by using laser spot welding in which spot portions are arranged parallel to the longitudinal direction.

Figure 3:
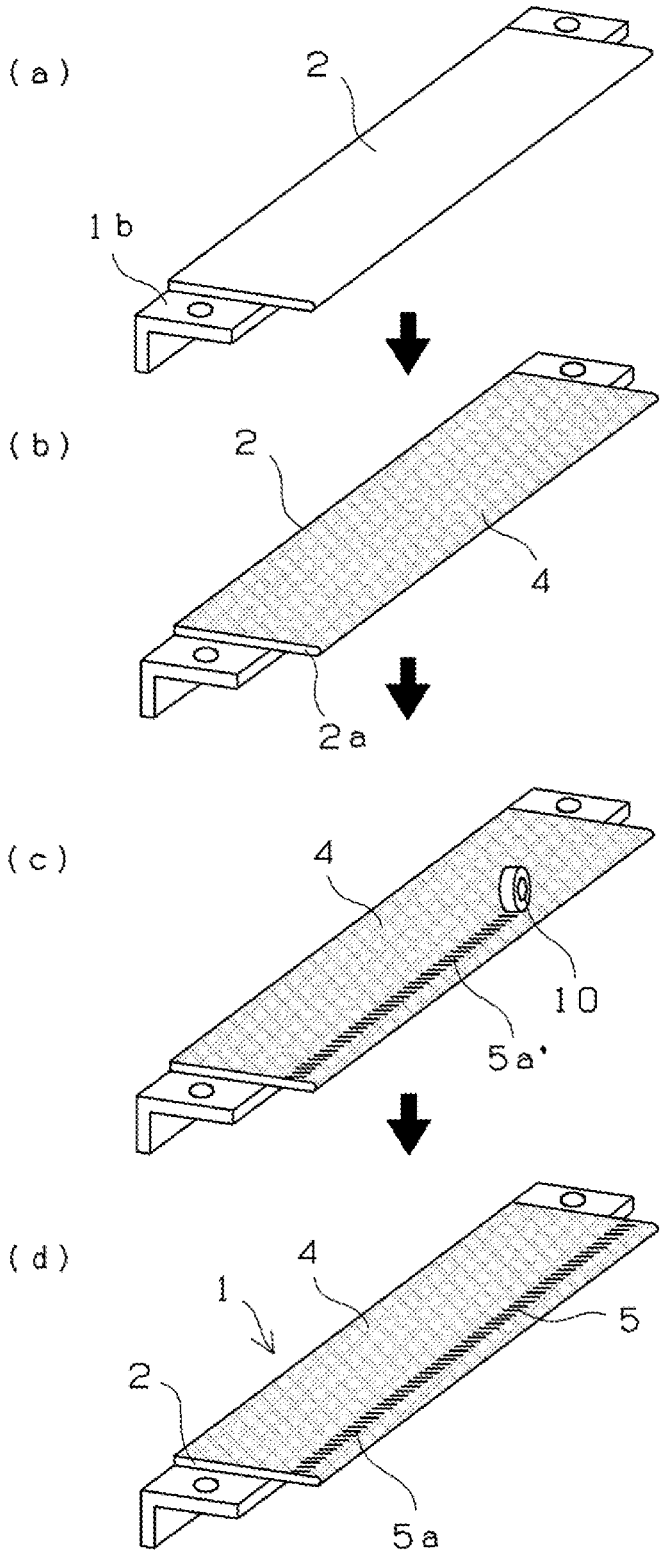
FIG. 3 illustrates a view of a manufacturing process of the peeling member of the present invention.
Figure 4:
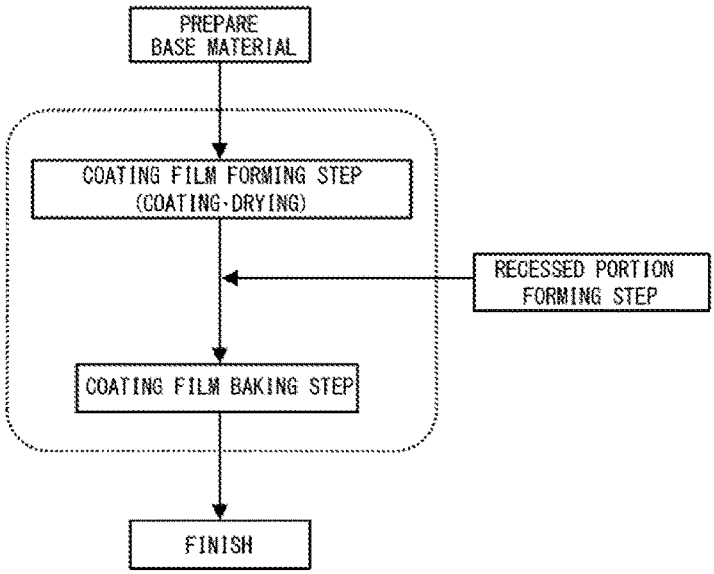
FIG. 4 illustrates a view of a flow of the manufacturing process in a manufacturing method of the present invention.

A manufacturing method of the present invention is for manufacturing such a peeling member. The manufacturing method of the present invention is described with reference to FIG. 3 and FIG. 4. FIG. 3 is a schematic view illustrating the process in the manufacturing method. FIG. 4 is a flow of the process in the manufacturing method. In the manufacturing method of the present invention, after preparing the base material of the peeling member, (1) a coating film forming step, (2) a recessed portion forming step, and (3) a coating film baking step are performed in this order. Especially, the coating film forming step and the coating film baking step are normally continuously performed (shown by a dotted line in FIG. 4), while the recessed portion forming step is performed between the coating film forming step and the coating film baking step. Each process is described below.

At first, as shown in (a) of FIG. 3, the base material 2 of the peeling member is prepared. As the base material 2, the support member 1*b* to which the metal plate or the resin plate described above is fixed is prepared. Here, in order to improve the adhesiveness with the resin coating film, a surface on which the resin coating film is formed of the base material formed of the metal plate is roughened to form an uneven shape by means of shot blast, tumbler, machining or the like, or alternatively a fine uneven shape may be formed by applying a chemical surface treatment. Further, the fixing of the base material 2 and the support member 1*b* can be performed at any stage, and therefore the fixing may be performed after the coating film is formed (after the baking).

(1) Coating Film Forming Step

As shown in (b) of FIG. 3, in the present step, the resin coating film 4 is formed by drying the resin coating material after applying the resin coating material including the matrix resin on a surface of the base material 2. As described above, the resin coating material is obtained by dispersing or dissolving the matrix resin and other compounding agent, which become a solid content, into a solvent. A coating method of coating the surface of the base material 2 with the resin coating material is not especially limited, and for example, a spray coating method may be adopted. Further, a powder coating method such as an electrostatic painting method may be adopted. The resin coating material may be applied on at least the paper passing side surface of the base material 2.

The drying in this step is performed to such an extent that the recessed portion can be formed in the next step of the recessed portion forming step. At this stage, the solvent included in the resin coating film is vaporized. In a state in which much solvent is remained in the resin coating material, the resin coating film has liquidity, and even if a recessed portion is formed by means of transfer, the coating material flows and therefore the recessed portion is collapsed. Thus, the resin coating material is dried to such an extent that a groove is not collapsed when forming the recessed portion even if a part of the solvent is remained in the resin coating film. Further, in a case in which a powder coating method is adopted, the process proceeds to the next step in a state in which the resin coating material is in a flexible gel state before the resin coating material is completely hardened. Specifically, it means a state in which a ratio of the solid content in the resin coating film is 70 wt. % or more. The ratio of the solid content in the resin coating film can be managed easily by measuring each weight of a product before coating, right after coating, and after drying.

Further, by setting a film thickness of the resin coating film after drying to 12 μm to 36 μm, the resin coating film after baking is formed in a required film thickness. Further, in a case in which a finishing process is performed after baking, the film thickness of the resin coating film after drying may be set to 20 μm to 50 μm.

(2) Recessed Portion Forming Step

As shown in (c) of FIG. 3, in the present step, a portion (recessed portion 5*a*') to be the recessed portion that forms the pattern portion is formed on the surface of the resin coating film 4 after the coating film forming step. The resin coating film 4 obtained in the coating film forming step, which is the former step, is low in strength and in a flexible state, compared to the resin coating film after baking. The present step is performed right after the coating film forming step to use the state of the resin coating film. The recessed portion 5*a*' formed in the present step eventually becomes the pattern portion 5 on the surface of the resin coating film of the peeling member through the next step of the baking step. A shape of the pattern portion formed by the recessed portion 5*a*' is substantially the same as a shape of the completed pattern portion 5.

The shape of the recessed portion is described above. In a case in which the recessed portion is formed as liner grooves inclined in one direction or two directions against the paper passing direction and aligned along the longitudinal direction of the peeling sheet at the same interval, namely in a case of the one direction inclined pattern groove and the twill pattern groove, as shown in (c) of FIG. 3, the recessed portion is formed by pressing a rotation member 10 including an outer periphery having a helical gear shape against the surface of the resin coating film 4 while rotating. Examples of the rotation member 10 include a knurling piece and a gear.

(3) Coating Film Baking Step

As shown in (d) of FIG. 3, in the present step, the resin coating film on which the recessed portion is formed in the recessed portion forming step, which is the former step, is baked to harden the resin coating film. The baking is performed at a baking temperature in accordance with the matrix resin. The resin coating film is baked and hardened through the baking step and then firm resin coating film 4 with the pattern portion 5 having a predetermined shape is obtained. Further, the thickness of the resin coating film after the baking is thinner than the film thickness before the baking by approximately 20%.

The thickness of the resin coating film in the peeling member 1 is 10 μm to 30 μm. The finishing process may be performed by cutting the surface of the resin coating film after the baking by using a cutting tool so as not to collapse the groove. The peeling member 1 having the pattern portion 5 obtained by this manufacturing method can reduce an area directly slid on a paper due to a fineness of the pattern portion 5.

EXAMPLE

Example 1

The peeling member 1 shown in FIG. 2 was experimentally produced. A detail thereof is as below. A metal thin plate (the base material 2) formed of stainless steel (SUS304CSP) having a thickness of 20 μm is cut into a plate having a length of 300 mm and a width of 40 mm, and burrs on a cut surface are clearly removed. Next, a metal thick plate (the support member 1*b*) formed of stainless steel (SUS304CSP) having a thickness of 1 mm is cut into a plate having a length of 360 mm and a width of 40 mm and then the plate is bent into an L-shape by 90 degrees at a position of 10 mm from an edge. Further, the holes 3 having φ 8 are formed at a left portion and a right portion respectively. The metal thin plate is welded to the metal thick plate by means of laser welding. At this time, the metal thin plate is welded to the metal thick plate such that the distal end portion 2*a* of the metal thin plate to be adjacent to the fixing roller is protruded from the metal thick plate by 5 mm. The metal thin plate is coated with a slidable resin coating material (Bearee FL7067 made by NTN Engineering Plastics Corporation) in which the matrix resin is formed of a PAI resin, by means of spray coating and then dried in a drying furnace at a temperature of 90° C. for approximately 10 minutes. The film thickness of the resin coating film at this moment was 24 μm. After drying, the peeling member is taken out from the drying furnace immediately, and then the one direction inclined pattern groove (the pattern portion 5) having a groove width of 11 mm and a depth of 30 μm is formed along the longitudinal direction by pressing a knurling piece (QUICK made by Ishida machine tool Co., Ltd, a pitch of 0.8 mm, R of 30°) on a portion of the surface of the resin coating film 4 to be slid on a paper. After that, the resin coating film is baked and hardened at a temperature of 240° C. for one hour. The film thickness of the resin coating film after the baking was 20 μm.

The peeling member of the example 1 was set in a fixing portion of a heat roller type test copying machine (fixing temperature of 190° C., copying speed of A4 size of 57 sheets/minute), and continuous paper feeding of 1,000 sheets of A4 plain papers on which a line chart having an image ratio of 80% was printed was performed, and then printing of an image having an image ratio of 99% on A4 plain papers was performed. After that, occurrence of the jamming due to adhesion was checked. As a result, the printing was performed without any problem. Adhesion of toner and damage of the resin coating film were not generated on the resin coating film checked after the paper feeding test.

Comparative Example 1

Figure 5:
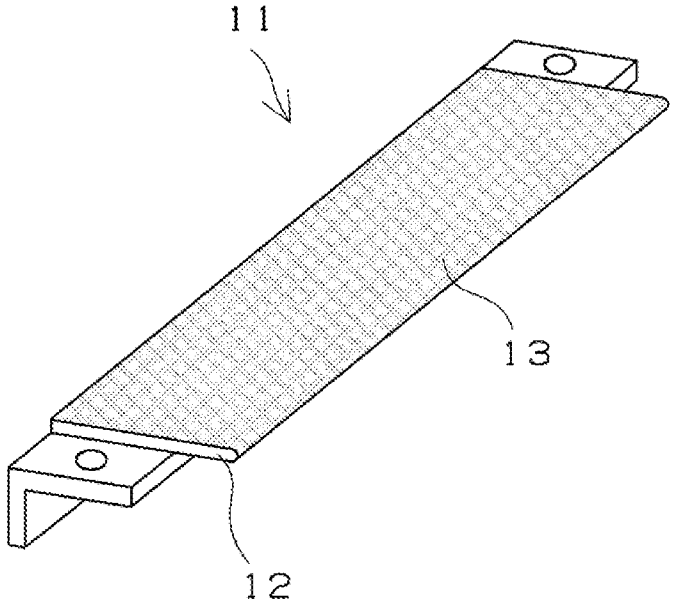
FIG. 5 illustrates a perspective view of a peeling member of a comparative example.

A peeling member 11 shown in FIG. 5 was experimentally produced. The peeling member 11 was produced by using the material, the size, and the procedure similar to those of the example 1 except that the one direction inclined pattern groove is not formed on a surface of a resin coating film 13 on a base material 12.

The peeling member was set in the test copying machine used in the example 1, and the copying test in which the papers are continuously fed as same as that in the example 1 was performed. As a result of the test, in the paper peeling device of the comparative example 1, the continuous paper feeding of 1,000 sheets of A4 plain papers on which a line chart having an image ratio of 80% was printed was completed without any problem, however when the printing of an image having an image ratio of 99% on A4 plain papers was performed, the paper was adhered to the peeling member and the jamming due to the adhesion occurred.

INDUSTRIAL APPLICABILITY

The peeling member of the present invention formed by a metal plate or the like and a resin coating film formed on the metal plate can prevent adhesion of a paper right after fixing for a long period of time, and therefore the peeling member is preferably used for peeling a paper from various rollers such as a fixing roller installed in an electronic photographic device.

REFERENCE SIGNS LIST

1: peeling member
2: base material
3: hole
4: resin coating film
5: pattern portion formed by a plurality of recessed portions
6: fixing roller
7: pressing roller
8: nip portion
9: paper
10: rotation member

The invention claimed is:

1. A peeling member comprising a peeling sheet formed by a base material having a plate shape, and a resin coating film formed on at least a surface of the base material at a paper passing side, the peeling member being configured to peel a paper from a fixing member of an electronic photographic device by arranging a distal end portion, which is an end portion at a side of one long side of the peeling sheet and at an upstream side in a paper passing direction, to be contacted with or close to the fixing member, wherein a width of the base material is not less than half of a length of the fixing member in an axial direction and is equal to or slightly longer than the length of the fixing member in the axial direction, wherein the resin coating film comprises a matrix resin and fluororesin powder, wherein the resin coating film comprises a plurality of recessed portions on a surface of the resin coating film at the paper passing side, and a recess is not formed on the base material as a base part of the recessed portion.

2. The peeling member according to claim 1, wherein the recessed portion is formed as linear grooves inclined in one direction or two directions against the paper passing direction and aligned along a longitudinal direction of the peeling sheet at the same intervals.

3. The peeling member according to claim 1, wherein: the resin coating film comprises graphite powder; and the resin coating film contains 25 to 70 parts by weight of the fluororesin and 1 to 20 parts by weight of the graphite against 100 parts by weight of the matrix resin.

4. The peeling member according to claim 3, wherein the matrix resin is formed of a polyamide imide resin.

5. The peeling member according to claim 3, wherein: the fluororesin is formed of a polytetrafluoroethylene resin; the graphite contains 97.5% or more of fixed carbon.

6. A manufacturing method for the peeling member according to claim 1, comprising: a coating film forming step of forming a resin coating film by drying a resin coating material after applying the resin coating material including a matrix resin on at least a surface of the base material of the peeling member at the paper passing side; a coating film baking step of baking and hardening the resin coating film; and a recessed portion forming step of forming a portion, which becomes a recessed portion when the coating film baking step is performed, on the surface of the resin coating film at the paper passing side, after the coating film forming step and before the coating film baking step.

7. The manufacturing method of the peeling member according to claim 6, wherein: the recessed portion is formed as linear grooves inclined in one direction or two directions against the paper passing direction and aligned along a longitudinal direction of the peeling sheet at the same intervals; and the linear groove is formed in the recessed portion forming step by pressing a rotation member including an outer periphery having a helical gear shape against the surface of the resin coating film while rotating.

* * * * *